US008407917B2

(12) United States Patent
Barrick

(10) Patent No.: US 8,407,917 B2
(45) Date of Patent: Apr. 2, 2013

(54) APPARATUS, SYSTEM, AND METHOD FOR SHOE COVER

(76) Inventor: Michael Barrick, Cedar City, UT (US)

( * ) Notice: Subject to any disclaimer, the term of this patent is extended or adjusted under 35 U.S.C. 154(b) by 433 days.

(21) Appl. No.: 12/753,667

(22) Filed: Apr. 2, 2010

(65) Prior Publication Data

US 2010/0251562 A1 Oct. 7, 2010

Related U.S. Application Data

(60) Provisional application No. 61/166,115, filed on Apr. 2, 2009.

(51) Int. Cl.
*A43B 3/16* (2006.01)

(52) U.S. Cl. ..... 36/7.1 R; 36/7.5; 36/113; 36/15

(58) Field of Classification Search ..... 36/7.1 R, 36/7.5, 7.6, 113, 132, 15, 100, 101
See application file for complete search history.

(56) References Cited

U.S. PATENT DOCUMENTS 2,495,984 A * 1/1950 Roy ..... 36/15
2,720,714 A * 10/1955 Flynn et al. ..... 36/7.5
2,932,910 A 4/1960 Brown
3,000,116 A * 9/1961 Ally ..... 36/101
3,019,533 A * 2/1962 Smith ..... 36/7.6
3,584,402 A * 6/1971 Silverman ..... 36/11.5
3,721,024 A * 3/1973 Innerbickler ..... 36/4
4,887,369 A * 12/1989 Bailey et al. ..... 36/101
4,893,421 A 1/1990 Folks
4,896,439 A 1/1990 Morgan
5,168,643 A 12/1992 Laurain
5,535,529 A 7/1996 Panteah
5,694,704 A 12/1997 Kasbrick
5,867,922 A 2/1999 Hull et al.
6,446,300 B1 * 9/2002 Sleezer ..... 15/227
2001/0018805 A1 * 9/2001 Basso ..... 36/10
2008/0168686 A1 * 7/2008 Rosen ..... 36/136

* cited by examiner

*Primary Examiner* — Marie Patterson

(74) *Attorney, Agent, or Firm* — Kunzler Law Group

(57) ABSTRACT

An apparatus, system, and method are disclosed for a shoe cover. The shoe cover is useful for muffling sound of the wearer. The apparatus contains a padded sole, an encasing material, vertical straps, an attachment mechanism on the straps, and a replaceable cover. The replaceable cover can be substituted when the replaceable cover becomes worn or when a different type of cover is desirable.

20 Claims, 10 Drawing Sheets

APPARATUS, SYSTEM, AND METHOD FOR SHOE COVER

CROSS-REFERENCES TO RELATED APPLICATIONS

This application claims priority to United States Provisional Patent Application No. 61/166,115 entitled "Apparatus, System, and Method for Stealth Hunting Shoe Cover" and filed on Apr. 2, 2009 for Michael Barrick, which is incorporated herein by reference.

BACKGROUND OF THE INVENTION

1. Field of the Invention

This invention relates to covers for shoes, and more particularly relates to sound proof covers for shoes.

2. Description of Related Art

Several professions and recreational activities require noiseless movement. In many instances, people are required to run or walk without creating noise caused by shoes, pressure on the ground, or other sounds associated with foot placement on the ground. For example, police and SWAT members often need to move noiselessly in order to fulfill their jobs, often with dangerous results if noise they do not move silently.

Additionally, old age, general foot problems, foot surgery, and other physical ailments associated with the feet often require a foot covering that increases comfort. In many cases, a foot covering is required to increase stability and comfort of a user's foot. For example, old age may cause the feet to become tender and may necessitate a foot covering that is more comfortable than conventional shoes.

In another example, hunters are often faced with the problem of scaring off game by making too much noise. Often, the noise is created by walking through the forest and stepping on branches, twigs, sticks, leaves, loose rocks, and other debris. Because the sound of the hunter usually scares away the game, the hunter may be unable to take a clear shot and may be unable to kill the game.

Hunters, and other professions such as SWAT members and police, have tried to remedy the problem of making noise with the feet by wearing tennis shoes but have found additional problems such as insufficient foot protection. In certain situations, currently available shoe covers have been used to reduce noise. Often, however, currently available shoe covers are heavy and add weight and discomfort to the user. Some of the shoe covers easily fall off the user's feet. In the case of a hunter, this causes interruptions in the hunt while adjustments to the shoes are made. Currently available shoe covers often move under the user's shoe while the shoe covers are in use, causing discomfort and injury. At times, the shoe covers wear out and must be replaced, costing the user more money than he or she had intended to spend on shoe covers.

There is a need for a new shoe cover that is light, easy to carry, durable, comfortable, and provides sound proofing to the steps of a user.

SUMMARY OF THE INVENTION

From the foregoing discussion, it should be apparent that a need exists for an apparatus, system, and method that provide a substantially sound proof, comfortable foot covering. Beneficially, such an apparatus, system, and method would be light and easy to carry, with a replaceable cover on the outside of the sole of each shoe cover.

The present invention has been developed in response to the present state of the art, and in particular, in response to the problems and needs in the art that have not yet been fully solved by currently available technology. Accordingly, the present invention has been developed to provide an apparatus, system, and method for substantially sound proof shoe covers that are light, easy to carry, and have replaceable covers.

The apparatus, in one embodiment, includes a sole, an encasing material, and a replaceable cover. In one embodiment, the sole includes a bottom surface, a top surface, and a lateral surface. In one embodiment, the lateral surface is disposed between the top surface and the bottom surface and encompasses a perimeter of the sole. In another embodiment, the perimeter of the sole is in the shape of a shoe sole.

In one embodiment, the encasing material is attached to and covers the bottom surface and lateral surface of the sole. In another embodiment, the encasing material includes a plurality of vertical straps disposed on a perimeter of the encasing material and extending in a direction away from the bottom surface of the sole. In one embodiment, the vertical straps include lace loops disposed on distal ends of the vertical straps. In one embodiment, the lace loops are annular structures. In another embodiment, the vertical straps also include encasing snaps disposed on an outer surface of the vertical straps.

In a further embodiment, the replaceable cover removably secures to the encasing material using cover snaps which correspond to and removably secure to the encasing snaps. In one embodiment, the replaceable cover covers an area defined by the bottom surface of the sole.

The apparatus, in one embodiment, includes a cord held to the encasing material by the lace loops disposed on the distal ends of the vertical straps. In another embodiment, the cord is threaded through opposing lace loops and secures the apparatus to a foot of a user. In yet another embodiment, the replaceable cover includes traction patches disposed on a bottom surface of the replaceable cover. In another embodiment, the encasing material also contains traction patches on a top surface of the encasing material.

In a further embodiment, the apparatus includes an ankle strap attached to at least one vertical strap. In one embodiment, the ankle strap includes a securable, annular material configured to secure to an ankle area of the user. In yet another embodiment, the sole is made of a compressible, resilient material that muffles sound. In one embodiment, the encasing material includes one of nylon, plush, cotton fabric, fleece, wool fabric, linen, felt, denim, canvas, latex, nylon, neoprene, leather, and terry cloth.

In another embodiment, the apparatus includes a top cover connected with at least one portion of the perimeter of the foam sole. In one embodiment, the top cover creates a pocket between the top cover and the encasing material. In one embodiment, the replaceable cover includes eight cover snaps which correspond to eight encasing snaps. In another embodiment, the top surface of the sole includes a foot indentation.

In one embodiment, the vertical straps include secondary snaps disposed on an inner surface of the vertical straps. In a further embodiment, the secondary snaps correspond to boot snaps disposed on a foot covering of the user. In one embodiment, the sole includes a plurality of pieces of foam which are attached together. In another embodiment, the sole, encasing material, and replaceable cover are waterproof.

A method is also described. In one embodiment, the method starts and a sole is provided. In one embodiment, the sole includes a bottom surface, a top surface, and a lateral surface. In another embodiment, the lateral surface is disposed between the top surface and the bottom surface and encompasses a perimeter of the sole. In one embodiment, the perimeter of the sole is in the shape of a shoe sole.

In one embodiment, the encasing material is attached to the sole such that the encasing material covers the bottom surface and the lateral surface of the sole. In a further embodiment, vertical straps are providing and disposed on the encasing material. In one embodiment, the vertical straps include lace loops configured to receive a cord.

The method, in another embodiment, includes lacing the cord through opposing lace loops such that the vertical straps can be pulled together by shortening the cord. In another embodiment, the method includes securing a replaceable cover to the encasing material such that the replaceable cover covers the bottom surface of the encasing material.

In one embodiment, the vertical straps include encasing snaps disposed on an outer surface of the vertical straps. In another embodiment, the method includes providing an ankle strap attached to at least one lace loop and secured to an ankle of a user. In yet another embodiment, the replaceable cover includes traction patches disposed on a bottom surface of the replaceable cover.

A system is also disclosed which includes a sole, an encasing material, a replaceable cover, a cord, and an ankle strap. In one embodiment, the sole includes a bottom surface, a top surface, and a lateral surface. In one embodiment, the lateral surface is disposed between the top surface and the bottom surface and encompasses a perimeter of the sole. In yet another embodiment, the perimeter of the sole is in the shape of a shoe sole.

In another embodiment, the system includes an encasing material attached to and covering the bottom surface and lateral surface of the sole. In one embodiment, the encasing material includes a plurality of vertical straps disposed on a perimeter of the encasing material and extending in a direction away from the bottom surface of the sole. In a further embodiment, the vertical straps further comprise lace loops disposed on distal ends of the vertical straps. In one embodiment, the lace loops are annular structures. In another embodiment, the vertical straps also include encasing snaps disposed on an outer surface of the vertical straps In one embodiment, the system also includes a replaceable cover removably secured to the encasing material. In one embodiment, the replaceable cover removably secures to the encasing material by cover snaps which correspond to and removably secure to encasing snaps. In another embodiment, the replaceable cover covers an area defined by the bottom surface of the sole.

In one embodiment, a cord is laced through opposing lace loops such that the cord holds the apparatus to the foot of a user. In another embodiment, an ankle strap is attached to at least one vertical strap. In another embodiment, the ankle strap includes a length of fabric material. In yet another embodiment, the sole is slightly larger than a sole of a user's shoe.

In another embodiment, the system also includes at least one additional replaceable cover. In one embodiment, the ankle strap includes a cam buckle which locks one lateral end of the ankle strap to an opposite lateral end of the ankle strap such that the ankle strap secures to an ankle of a user.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not, therefore, to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
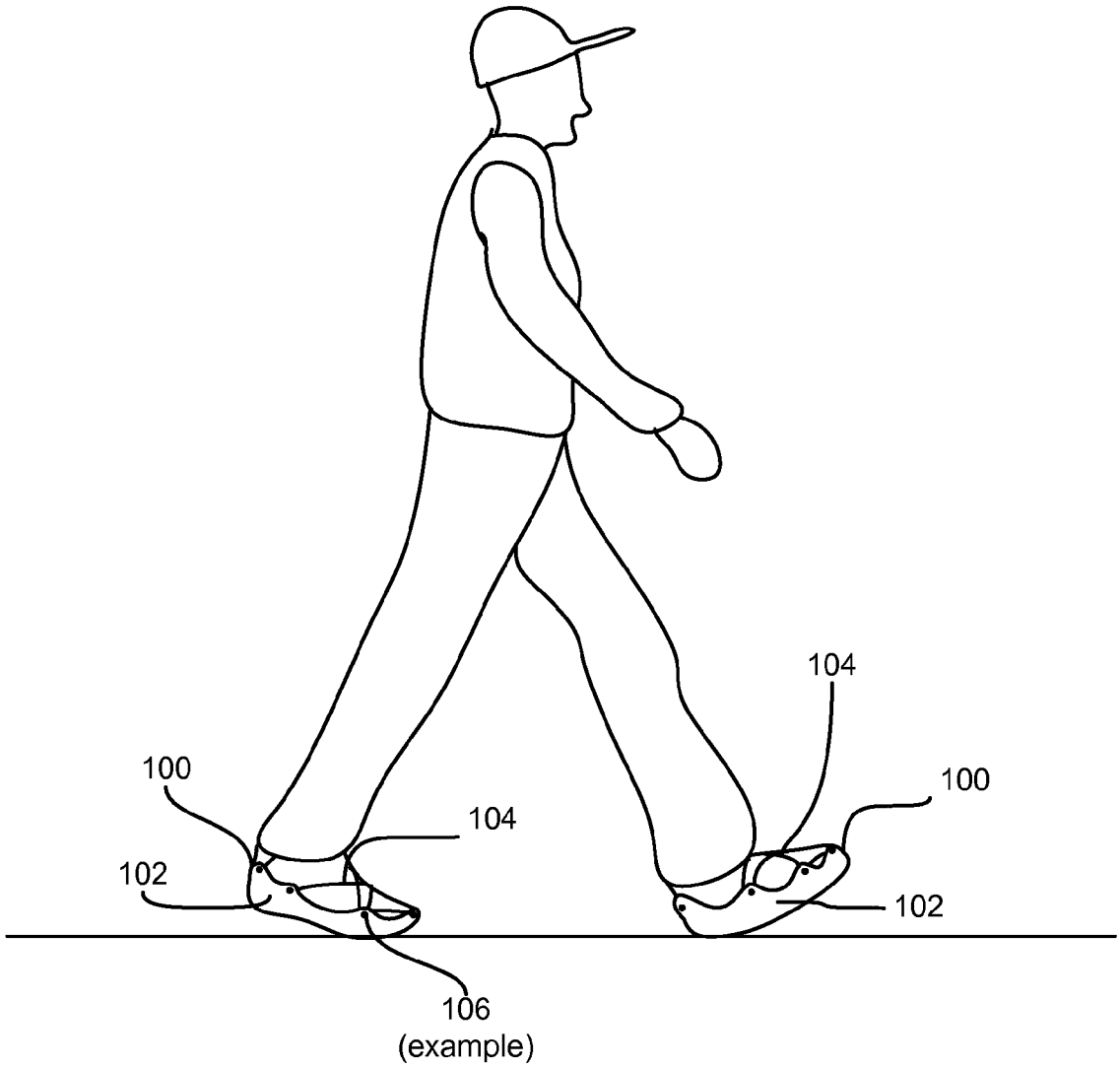
FIG. 1 is view of a user wearing one embodiment of the apparatus.

FIG. 1 shows a user wearing one embodiment of the apparatus 100. In one embodiment, the apparatus 100 includes a sole 222 (not shown in FIG. 1), an encasing material 219 (not shown in FIG. 1), a replaceable cover 102, and a cord 104. The apparatus 100 is held to the user's boot 208 or foot through the use of the cord 104 and an ankle strap 212 (not shown in FIG. 1). The ankle strap 212 is located towards a rear portion of the apparatus 100 to correspond with the location of the user's ankle. The user is thus able to walk while the apparatus 100 is held to the user's foot.

When the apparatus 100 is worn by the user, the user's foot steps downward on the apparatus 100 rather than directly onto the ground. The apparatus 100 contains a sole 222 which dampens the force of the user's foot, spreads the dampened force over a slightly larger area, and dampens sound produced by the user's footsteps. The sole 222 can be of thickness selected to provide sound dampening and comfort for the user. A heavier user may prefer a thicker sole 222 with more sound dampening capabilities. A user that plans on moving over long distances may prefer a thinner sole 222 to make traveling more comfortable. The sole 222 is held to the foot or shoe of the user such that the user can walk normally while participating in activities where the user desires to reduce noise produced by his or her feet, such as hunting.

As shown in FIG. 1, in one embodiment, the replaceable cover 102 is the primary contact with the ground on which the user is walking. In this manner, the other portions of the apparatus 100 are preserved and may not need to be replaced as often as the replaceable cover 102. The user can replace the replaceable cover 102 when it becomes worn so that the encasing material 219 and sole 222 need not contact the ground. Additionally, the replaceable cover 102 can be selected for different characteristics, such as thickness, wear, sound muffling, etc. and can be substituted for different uses.

In one embodiment, fastening devices such as cover snaps 160 in one embodiment hold the replaceable cover 102 to the encasing material 219. In one embodiment, the cover snaps 106 removably secure the replaceable cover 102 to the encasing material 219. In this manner, the replaceable cover 102 is very easy to remove and replace. The user can simply un-snap the cover snaps 106 from the encasing snaps 240 (shown in FIG. 3) and remove the replaceable cover 102. The worn replaceable cover 102 can then be replaced with a new replaceable cover 102.

When a user desires to remove the apparatus 100 from the user's foot, the apparatus 100 is removed in one embodiment by loosening the cord 104, unlatching the ankle strap 212, and removing the user's foot from the apparatus 100. While the apparatus 100 is attached to the user's foot, the user can walk, as shown in FIG. 1, run, or perform other actions normally conducted while wearing shoes.

In one embodiment, the apparatus 100 includes several additional replaceable covers. In one embodiment, the apparatus 100 includes one additional replaceable cover which is thinner than the replaceable cover 102 and a user may use the additional replaceable cover on harder walking surfaces. In another embodiment, the apparatus 100 includes one additional replaceable cover which is wider than the replaceable cover 102 and the user may use the additional replaceable cover on sandy surfaces. In various embodiments, the additional replaceable covers may have additional traction patches 209. In one embodiment, the traction patches 209 are between 2 inches thick and a quarter of an inch thick.

Figure 2:
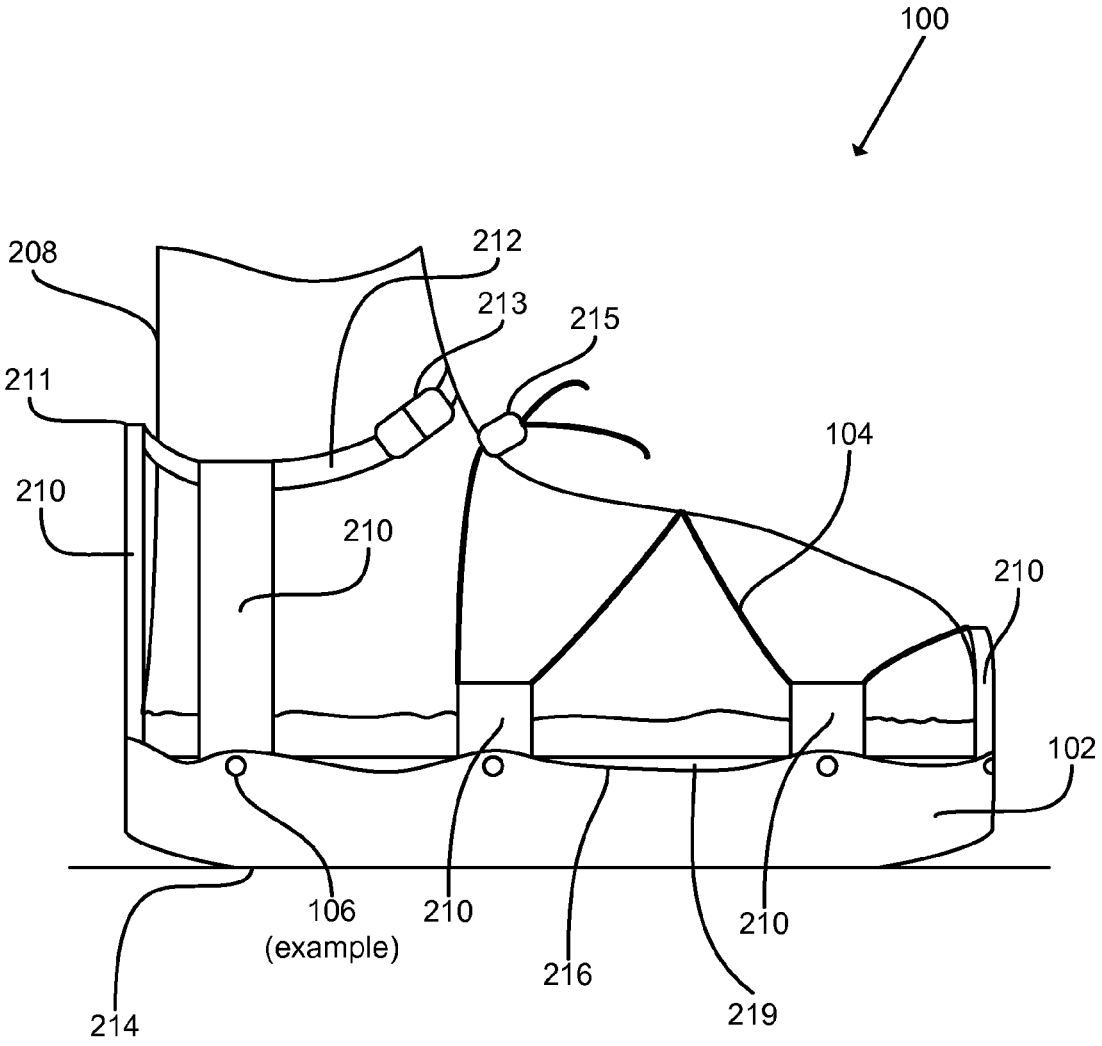
FIG. 2 is a side view of the apparatus while attached to a boot in accordance with the present invention.

FIG. 2 shows a close-up side view of the apparatus 100 while attached to a user's boot 208. As will be recognized by one of skill in the art, the apparatus 100 can attach to a user's boot 208, shoe, sandal, bare foot, or any other foot covering worn by a user. In one embodiment, the apparatus 100 is secured to the user's boot 208 through the use of a fastening mechanism. The fastening mechanism may be any type of fastening device. In one embodiment, the fastening mechanism is formed with hook and loop fastening material. A portion or all of the fastening mechanism may be straps having hook and loop material connected to the ends thereof. For instance, the vertical straps 210 may be formed with distal ends having hook and loop fasteners rather than or in supplementation of the cord 104.

FIG. 2 depicts the replaceable cover 102 with the cover snaps 106, the vertical straps 210, the ankle strap 212, and the cord 104. In one embodiment, the apparatus 100 is secured to the user's boot 208 through the use of the cord 104 and the ankle strap 212. In one embodiment, the apparatus 100 is secured to the user's boot 208 solely through the use of the cord 104. In another embodiment, the apparatus 100 is secured to the user's boot 208 solely through the use of the ankle strap 212. In yet another embodiment, the apparatus 100 is secured to the user's boot 208 through the use of both the ankle strap 212 and the cord 104.

The replaceable cover 102 is attached to the apparatus 100 such that the replaceable cover 102 covers a bottom portion 214 of the apparatus 100. In one embodiment, the replaceable cover 102 covers the bottom portion 214 of the apparatus 100 such that the encasing material 219 and the sole 222 do not contact the ground when a user uses the apparatus 100. In various embodiments, the amount of area of the encasing material 219 and sole 222 covered by the replaceable cover 102 varies. In one embodiment, the replaceable cover 102 covers a bottom surface of the sole 222 as well as a portion of the lateral surface of the sole 222. In other embodiments, the replaceable cover 102 covers only the bottom surface of the sole 222 and does not extend to cover the lateral surface of the sole 222.

In one embodiment, the replaceable cover 102 includes cover snaps 106. The cover snaps 106 are located near an outer edge 216 of the replaceable cover 102 and are spaced along the outer edge 216. The cover snaps 106 correspond with encasing snaps 240 (not shown in FIG. 2) on the vertical straps 210. The cover snaps 106 removably hold the replaceable cover 102 to the encasing material 219. To change and replace the replaceable cover 102, the cover snaps 106 are unlocked from the encasing snaps 240 and the replaceable cover 102 is removed. To attach a new replaceable cover 102, the cover snaps 106 from the new replaceable cover 102 are attached to corresponding encasing snaps 240 on the vertical straps 210.

While the embodiment of FIG. 2 shows a replaceable cover 102 with three cover snaps 106 on one side of the replaceable cover 102, the replaceable cover 102 may have any number of cover snaps 106. In one embodiment, the replaceable cover 102 has a total of ten cover snaps 106.

Additionally, in various embodiments, the replaceable cover 102 is made from several different materials. In one embodiment, the replaceable cover 102 is made of polyester fleece. In other embodiments, the replaceable cover 102 is made of one of plush, cotton fabric, wool fabric, linens, felt, denim, canvas, latex, nylon, neoprene, leathers, and terry cloth. In one embodiment, the replaceable cover 102 includes polyester fleece, specifically anti-pill fleece, berber, or sherpa fleece. One of skill in the art will recognize that the replaceable cover 102 can be made from any combination of these materials and other materials. In one embodiment, for example, the replaceable cover 102 contains a more durable material on an area that may contact the ground as the user walks, and a less durable, less expensive material on lateral surfaces of the sole 222.

In one embodiment, the replaceable cover 102 is made from a material with sound dampening characteristics. In one embodiment, the replaceable cover 102 is made from a waterproof material.

In the embodiment of FIG. 2, the replaceable cover 102 is made from a single piece of material that is stretched over the bottom portion 214 of the apparatus 100. In another embodiment, the replaceable cover 102 is made from a material that does not need to be stretched to cover the bottom portion 214 of the apparatus 100. In one embodiment, the replaceable cover 102 is held tightly against the encasing material 219 by being stretched to attach the cover snaps 106 to the corresponding encasing snaps 240.

Again with reference to FIG. 2, in one embodiment the encasing material 219 contains vertical straps 210 which protrude upward from the encasing material 219. In one embodiment, the vertical straps 210 extend in a direction perpendicular to a bottom surface of the sole 222. In another embodiment, the vertical straps 210 extend in a direction perpendicular to the bottom portion 214 of the sole 222. In another embodiment, the vertical straps 210 extend at an angle to the bottom surface of the sole 222.

The vertical straps 210 may be separate pieces of material or may be extensions of the encasing material 219. In one embodiment, the vertical straps 210 extend upward from the encasing material 219 to allow the user to attach the apparatus 100 to the user's foot. In one embodiment, the vertical straps 210 contain lace loops 230 (shown in FIG. 4) attached to distal ends 211 of the vertical straps 210. The lace loops 230 are located on a distal end 211 of the vertical straps 210 and are annular structures. The annular structure of the lace loops 230 allows for the passage of the cord 104. When the cord 104 passes through opposing lace loops 230, the cord 104 can be pulled to tighten the vertical straps 210 around the foot of the user.

In one embodiment, the lace loops 230 are made from the same material as the vertical straps 210 and are made by folding a distal end 211 of the vertical straps 210 and attaching the folded end to a lower portion of the vertical straps 210. In this manner an annular structure is made using the material of the vertical straps 210. The cord 104 can be passed through the lace loop 230. In another embodiment, the lace loops 230 are separate mechanisms that are attached to the vertical straps 210. In one embodiment, for example, the lace loops 230 are small cylinders that are sown to a top portion of the vertical straps 210.

Figure 3:
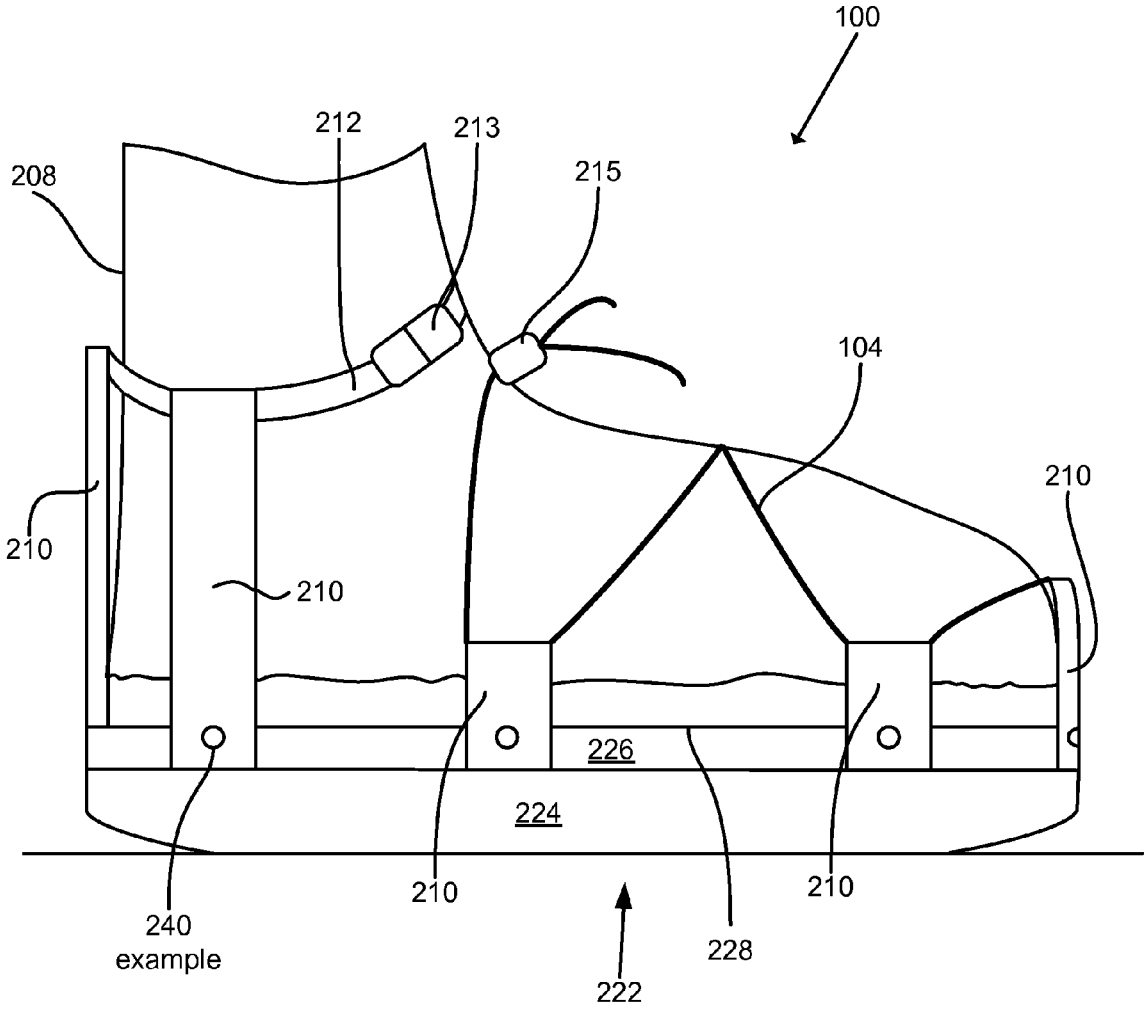
FIG. 3 is a side view of one embodiment of the apparatus without a replaceable cover attached in accordance with the present invention.

The vertical straps 210 can extend from an upper edge of the encasing material 219 or may extend from a lateral side of the encasing material 219, as best shown in FIG. 3. In one embodiment, the vertical straps 210 are from two inches (2") to six inches (6") in length.

In one embodiment, the vertical straps 210 contain encasing snaps 240 (as shown in FIG. 3) which correspond to cover snaps 106 of the replaceable cover 102. In another embodiment, the encasing snaps 240 are located on the encasing material 219 rather than the vertical straps 210. In another embodiment, the encasing snaps 240 are attached to both the encasing material 219 and the vertical straps 210. In either of these embodiments, the location of the encasing snaps 240 corresponds to the location of the cover snaps 106.

In one embodiment, the vertical straps 210 are made of 1" heavy polypropylene webbing. In various embodiments, the vertical straps 210 are made of nylon, polyester, leather, cotton fabric, wool fabric, denim, canvas, latex, nylon, neoprene, terry cloth, and a combination of materials. In one embodiment, the stitching for attachment of the vertical straps 210 to the encasing material 219 and the sole 222 is a nylon upholstery strength thread.

In one embodiment, the ankle strap 212 attaches to the vertical straps 210. In one embodiment, the ankle strap 212 is threaded through lace loops 230 located on the distal ends 211 of the vertical straps 210. In another embodiment, the ankle strap 212 is sown to the distal ends 211 of the vertical straps 210 (one embodiment is shown in FIG. 2). In another embodiment, the ankle strap 212 is threaded through the lace loop 230 and sown to the distal end 211 of the vertical straps 210. In one embodiment, the ankle strap 212 attaches to an ankle area of a user. In one embodiment, the ankle area of a user is any area near the ankle of a user. In one embodiment, the ankle area includes a calve of a user.

FIG. 2 also shows one embodiment of the cord 104 which connects the user's foot to the apparatus 100. In one embodiment, the cord 104 is threaded through the lace loops 230 of the vertical straps 210. The cord 104 can be crossed, in one embodiment, from one side of the encasing material 219 to an opposite side, such that pulling the cord 104 will narrow the distance between opposing vertical straps 210. In one embodiment, the cord 104 is made of nylon. In various other embodiments, the cord 104 is made of leather, rope, and bungee cord. In another embodiment, the cord 104 is made from parachute cord.

In one embodiment, the cord 104 is held in a tightened position using an acetyl plastic cord lock 215, which allows the user to tighten the cord 104 around the boot 208 of a user. One of skill in the art will recognize that other mechanisms can be used to lock the cord 104 in place.

Figure 2A:
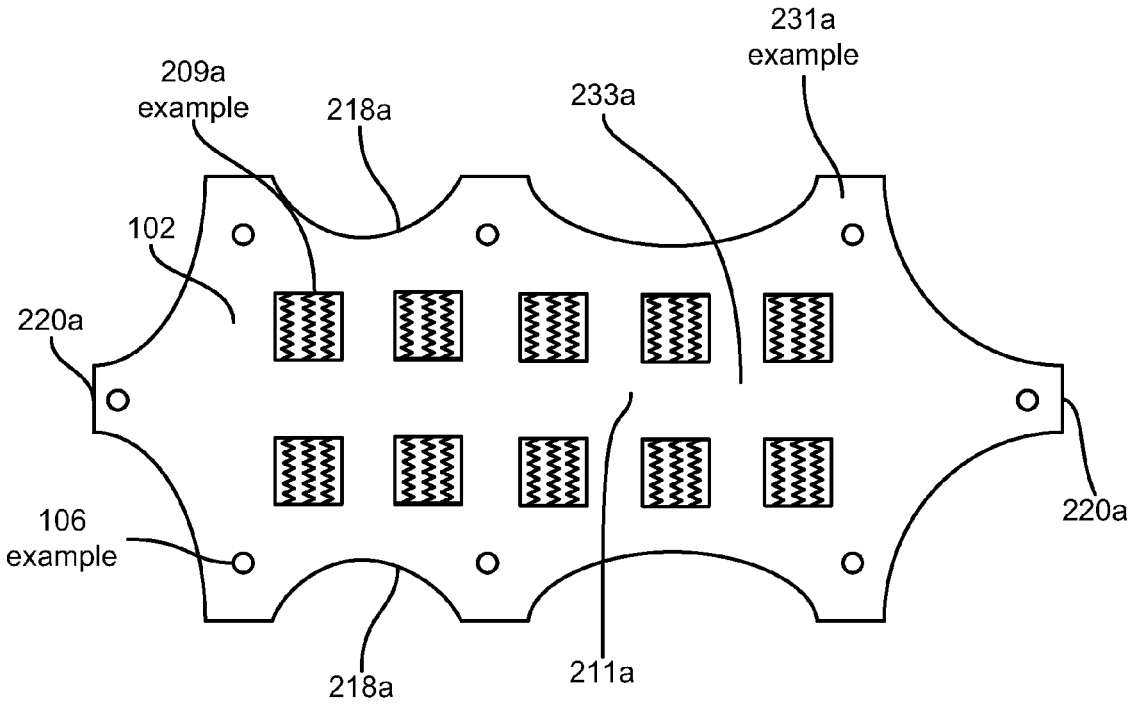
FIG. 2*a* is a top view of one embodiment of the replaceable cover in accordance with the present invention.
Figure 2B:
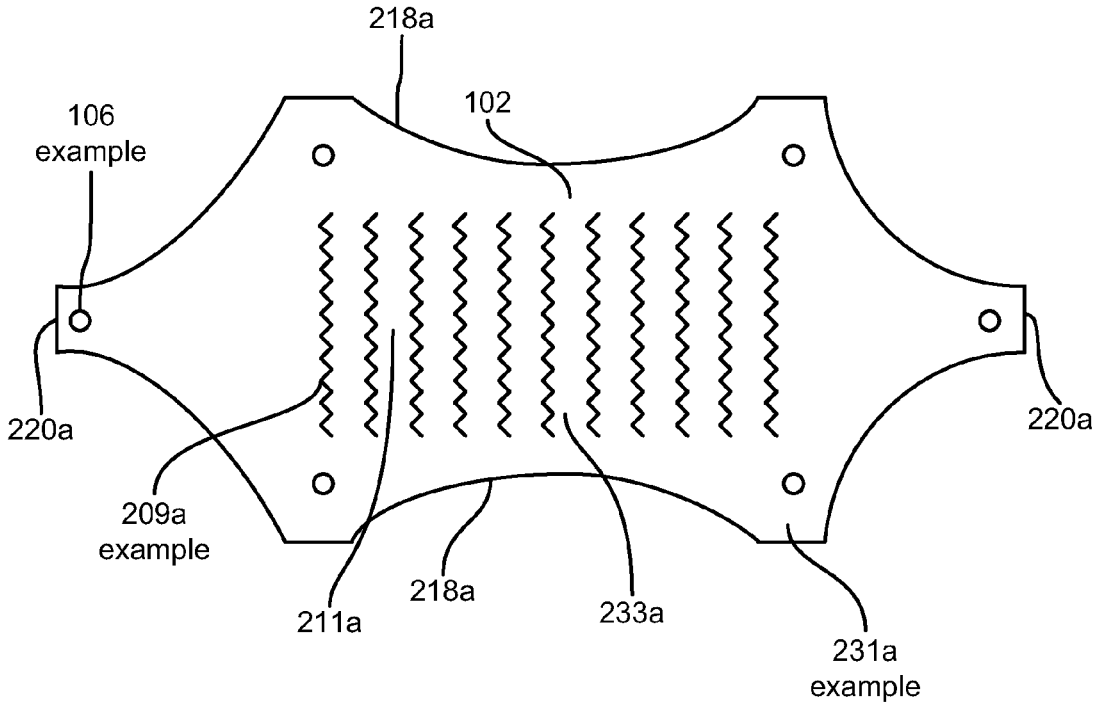
FIG. 2*b* is a top view of one embodiment of the replaceable cover in accordance with the present invention.

FIGS. 2*a* and 2*b* show various embodiments of the replaceable cover 102. FIG. 2*a* shows one embodiment of the replaceable cover 102 with eight cover snaps 106. Three cover snaps 106 are located along each longitudinal side 218*a* of the replaceable cover 102 while each lateral end 220*a* contains a single cover snap 106. The cover snaps 106 on the lateral ends 220*a* of the replaceable cover 102 hold the replaceable cover 102 to lateral ends of the apparatus 100. In one embodiment, the cover snaps 106 are located on a perimeter of the replaceable cover 102.

In one embodiment, the replaceable cover 102 contains flaps 231*a* which extend from a main body 233*a* of the replaceable cover 102 and allow the replaceable cover 102 to cover less of the lateral surface of the sole 222 when attached to the encasing material 219. The flaps 231*a* are spaced around the main body 233*a* of the replaceable cover 102 and correspond to the spacing of the vertical straps 210 of the encasing material 219. In the embodiment of FIGS. 2*a* and 2*b*, the flaps 231*a* have a flat portion and curved side portions. One of skill in the art will recognize that the flaps 231*a* can be shaped in several different shapes. In one embodiment, the flaps 231*a* are made from an elastic material which holds the replaceable cover 102 tightly to the encasing material 219.

In the embodiment of FIG. 2*a*, the replaceable cover 102 is constructed from a single piece of material. In another embodiment, the replaceable cover 102 is constructed of several different pieces of material. Also, FIG. 2*a* shows one embodiment of the replaceable cover 102 in which the replaceable cover 102 is substantially flat. In various other embodiments, the replaceable cover 102 is contoured and is made of several different fabric portions that are sown together at specified angles to create a contoured replaceable cover 102.

FIG. 2*a* also includes traction patches 209*a* disposed on a bottom surface 211*a* of the replaceable cover 102. In one embodiment, traction patches 209*a* are also disposed on a top surface of the encasing material 219 (not shown in FIG. 2*a*). In one embodiment, the top surface of the encasing material 219 is the surface which contacts a bottom portion of a foot of a user when the foot of the user is placed onto the apparatus 100. In one embodiment, the traction patches 209*a* are rectangular. In another embodiment, the traction patches 209*a* are straight lines. In one embodiment, the traction patches 209*a* are rubber. In one embodiment, the traction patches 209*a* are plastic. In various embodiments, the traction patches 209*a* are made of different materials.

FIG. 2*b* shows another embodiment of the replaceable cover 102 which contains six cover snaps 106 and six corresponding flaps 231*a*. As in FIG. 2*a*, in one embodiment, the flaps 231*a* are spaced around the main body 233*a* of the replaceable cover 102 and the spacing of the flaps 231*a* corresponds to the positioning of the vertical straps 210. In one embodiment, the flaps 231*a* may extend two inches (2") to six inches (6") from the main body 233*a*.

In various embodiments, the replaceable cover 102 may contain either the male or female portions of a typical snap mechanism. In one embodiment, the cover snaps 106 contain the female portion of the snaps and the encasing snaps 240 contain the male portion of the snaps. In another embodiment, the cover snaps 106 contain the male portion of the snaps and the encasing snaps 240 contain the female portion of the snaps.

In one embodiment, the cover snaps 106 and the encasing snaps 240 are an attachment mechanism which is capable of connecting the replaceable cover 102 with the encasing material 219. In various embodiments, the cover snaps 106 and the encasing snaps 240 are buttons, metal clasps, links, and Velcro® pieces. In other embodiments, the cover snaps 106 and the encasing snaps 240 include a combination of mechanisms which are capable of connecting the replaceable cover 102 with the encasing material 219. In one embodiment, the cover snaps 106 and the encasing snaps 240 are made of metal. In various other embodiments, the cover snaps 106 and the encasing snaps 240 are made of plastic, wood, and other suitable materials.

FIG. 2*b* also shows traction patches 209*a* disposed on a bottom surface 211*a* of the replaceable cover 102. In one embodiment, the traction patches 209*a* are formed in a zigzag shape.

FIG. 3 shows one embodiment of the apparatus 100 that includes the sole 222, the vertical straps 210, the encasing snaps 240, the ankle strap 212, the cord 104, and the cord lock 215, without the attachment of the replaceable cover 102. As discussed above, in one embodiment the vertical straps 210 attach to the sole 222 at evenly spaced locations. In one embodiment, the vertical straps 210 attach to the sole 222 on a lateral side of the sole 222.

The encasing material 219 of FIG. 2 is, in one embodiment, broken into a lower encasing material 224 and an upper encasing material 226. In this embodiment, the lower encasing material 224 may be different than the upper encasing material 226. For example, the upper encasing material 226 may be a camouflage design, while the lower encasing material 224 may be of a felt or high pile or otherwise silent, padded material as described above. In one embodiment, the vertical straps 210 attach to the sole 222 at a seam 228 between the lower encasing material 224 and the upper encasing material 226. The vertical straps 210 may be provided with a proximal end that is sewn into the seam 228 with the distal end emerging from the seam and the proximal end remaining within the sole 222.

In various embodiments, the encasing material 219 is made of nylon. plush, cotton fabric, fleece, wool fabric, linens, felt, denim, canvas, latex, nylon, neoprene, leathers, and terry cloth. In one embodiment, the encasing material 219 attaches to and covers the bottom surface, the lateral surface, and the top surface 531 of the sole 222.

Figure 4:
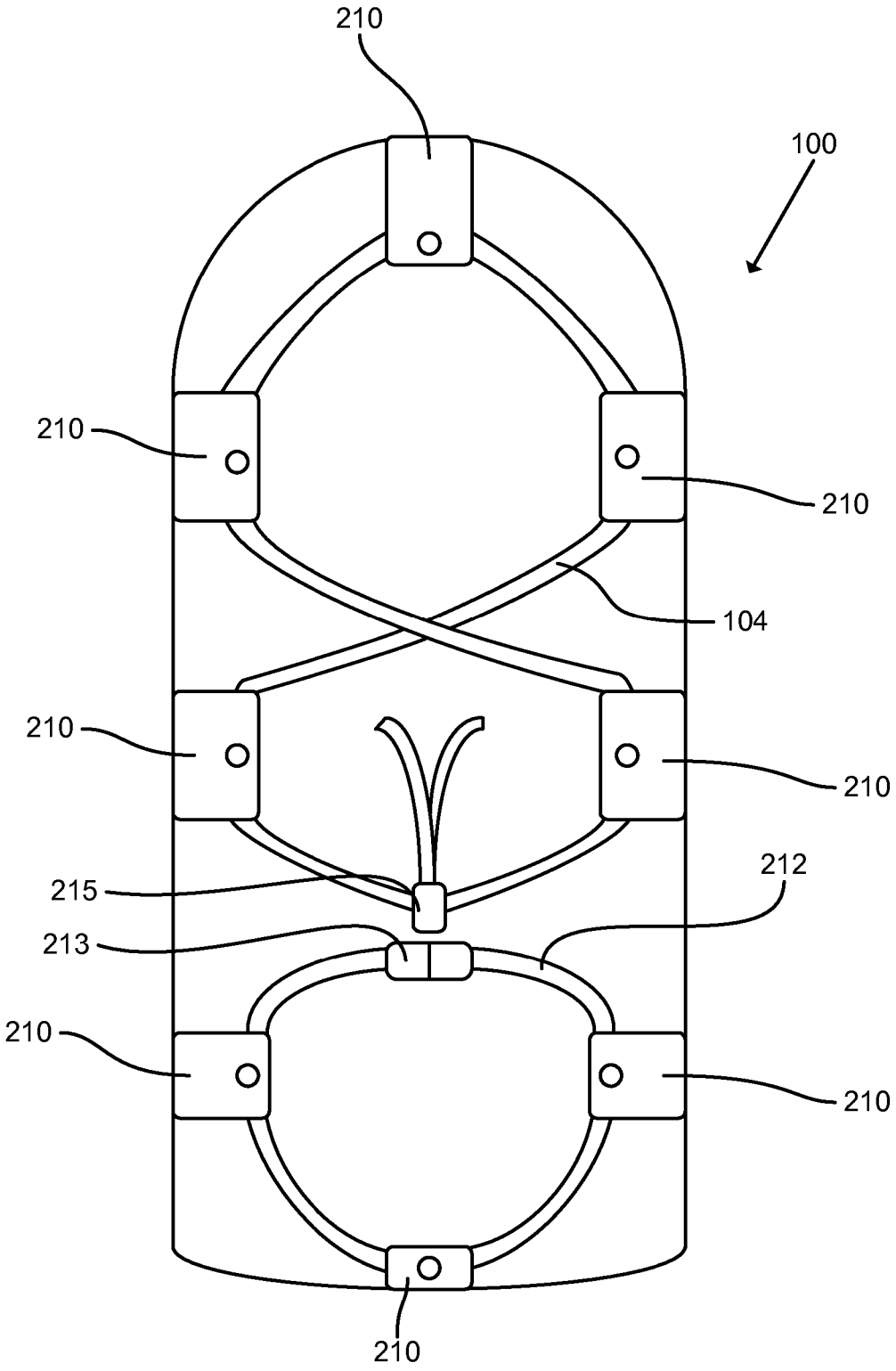
FIG. 4 is a top view of one embodiment of the apparatus without a replaceable cover attached in accordance with the present invention.

FIG. 4 depicts a top view of the apparatus 100 without the replaceable cover 102. In one embodiment, the vertical straps 210 are located around a perimeter of the encasing material 219. In one embodiment, the encasing snaps 240 are located on the vertical straps 210. In another embodiment, the cord 104 is laced through lace loops 230 located on distal ends 211 of the vertical straps 210. In yet another embodiment, then the cord 104 is tightened, the vertical straps 210 are pulled towards each other securing the apparatus 100 to the user's foot. In one embodiment, the cord 104 can then be held in place using the cord lock 215. In various embodiments, there may be any number of vertical straps 210 with corresponding encasing snaps 240.

In one embodiment, the ankle strap 212 is secured using a cam buckle 213. The ankle strap 212, in one embodiment, is configured to secure to the ankle of a user and is located in a rearward position on the encasing material 219.

In various embodiments, the circumference of the encasing material 219 and the sole 222 can be in many different shapes. In one embodiment, the circumference of the encasing material 219 is designed to be slightly larger than the shoe or boot 208 of the user. In various embodiments, the sole 222 and the encasing material 219 are made in different sizes and shapes to accommodate different users with different shoe sizes.

Figure 5:
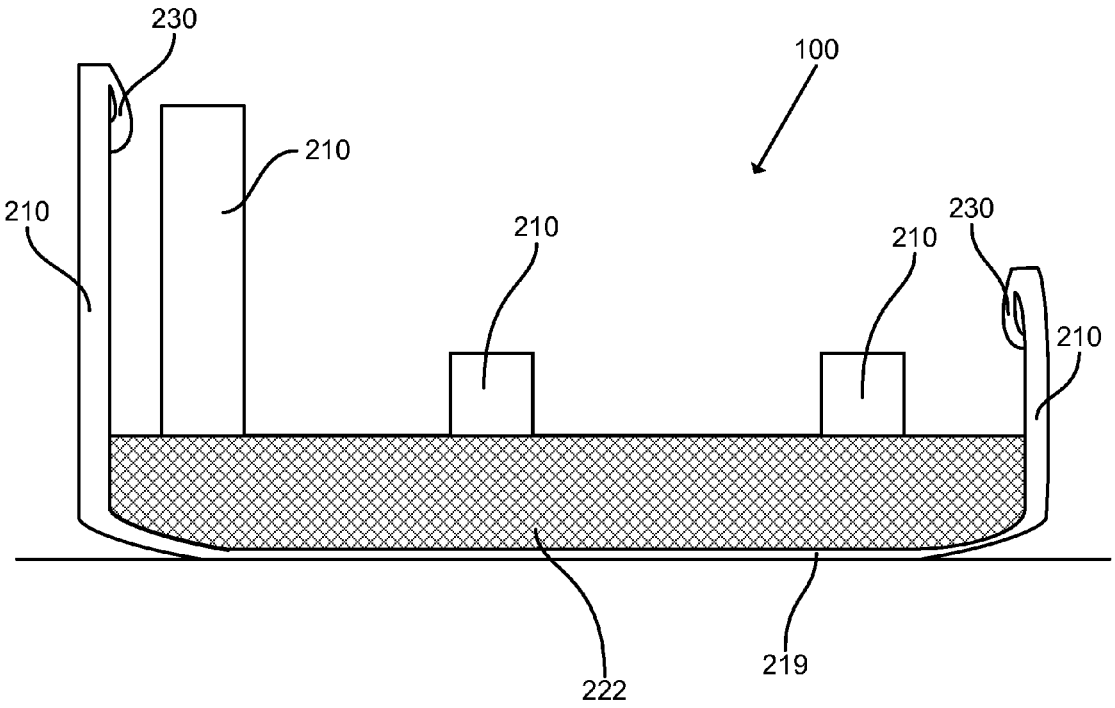
FIG. 5 is a cutaway side view of one embodiment of the sole and the encasing material in accordance with the present invention.

FIG. 5 shows a cutaway side-view of one embodiment of the apparatus 100 which includes the sole 222, encasing material 219, and vertical straps 210 without the replaceable cover 102. In one embodiment, the sole 222 is completely covered by the encasing material 219 on the bottom and the lateral surfaces. In one embodiment, the encasing material 219 provides a barrier between the sole 222 and the surface on which the apparatus 100 is placed. In other embodiments, the sole 222 is not completely covered by the encasing material 219. For example, in one embodiment, the sole 222 is not covered by the encasing material 219 on the lateral portions of the sole 222.

In one embodiment, the sole 222 is made of foam. In another embodiment, the sole 222 is made of multiple pieces of foam which are attached together. In one embodiment, the sole 222 is made of different types of foam which are positioned in different areas of the sole 222 such that a user's foot is properly and ergonomically supported. In one embodiment, the sole 222 includes HR foam.

In a further embodiment, the top surface 531 of the sole 222 includes a foot indentation (not shown in FIG. 5). In one embodiment, the foot indentation allows a user to wear the apparatus 100 on the user's feet without a shoe or boot 208.

Figure 5A:
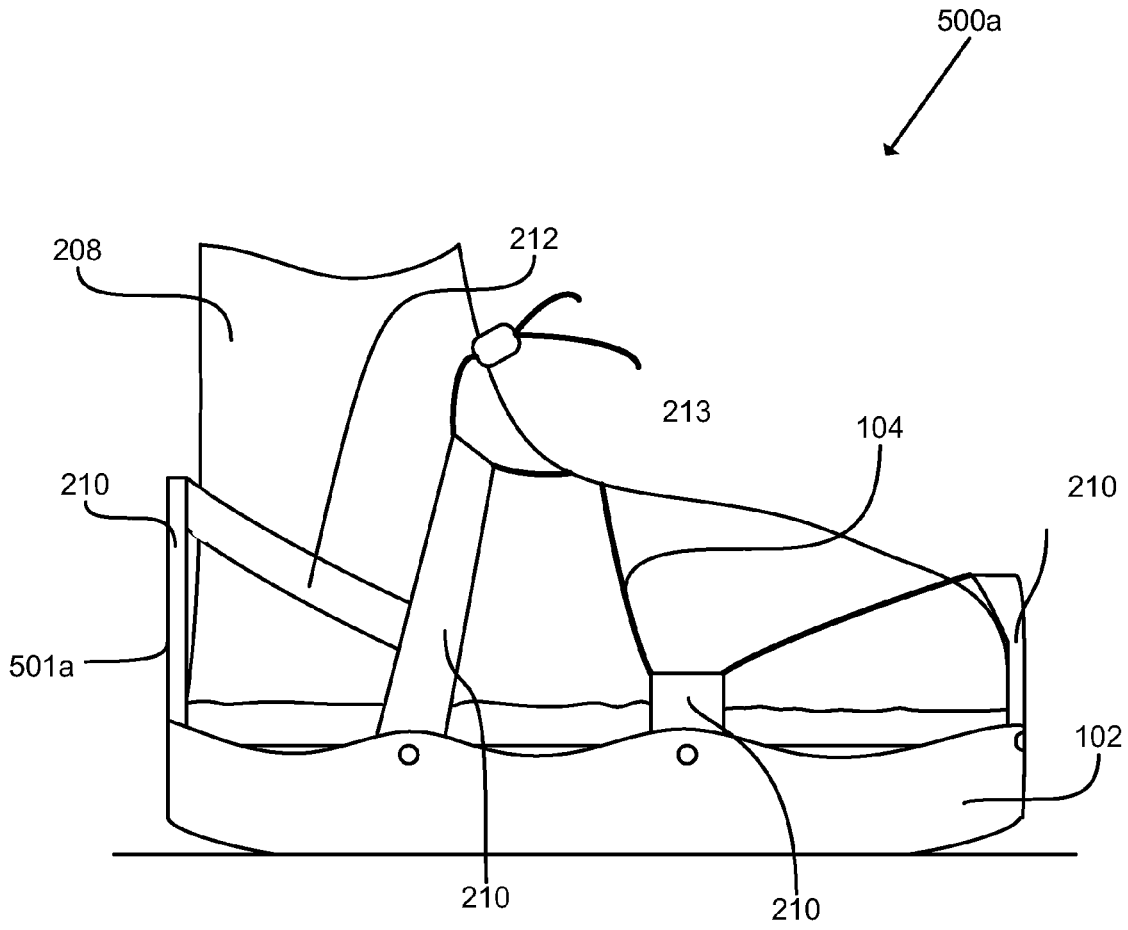
FIG. 5*a* is a side view of one embodiment of the apparatus in accordance with the present invention.

FIG. 5*a* depicts one embodiment of an apparatus 100*a* for a shoe cover that may be substantially similar to the apparatus 100 for a shoe cover of FIG. 1. The illustrated apparatus 100*a* includes the vertical straps 210, the ankle strap 212, the cord 104, and the replaceable cover 102. FIG. 5*a* also includes the boot 208 of a user. As described above, the vertical straps 210 are disposed on the perimeter of the encasing material 219 and extend in a direction away from the bottom surface of the sole 222.

In one embodiment, the ankle strap 212 includes a semicircle that extends from the vertical strap 210 on a side of the apparatus 100*a* to an opposite vertical strap 210 (not shown in FIG. 5*a*) on an opposite side of the apparatus 100*a*. In one embodiment, the ankle strap 212 attaches to a vertical strap 210 on a back end 501*a* of the apparatus 100*a*. In one embodiment, the apparatus 100*a* includes six vertical straps 210.

Figure 5B:
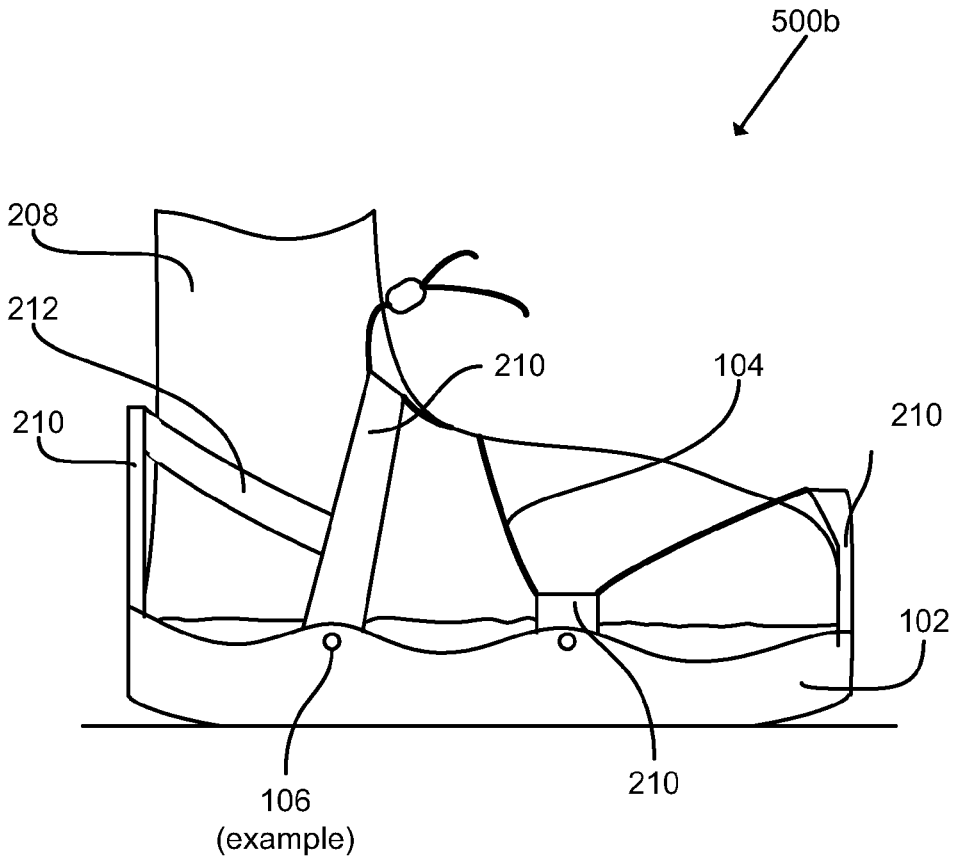
FIG. 5*b* is a side view of another embodiment of the apparatus in accordance with the present invention.

FIG. 5*b* depicts one embodiment of an apparatus 100*b* for a shoe cover that may be substantially similar to the apparatus 100 for a shoe cover of FIG. 1. The illustrated apparatus 100*b* includes the vertical straps 210, the ankle strap 212, the cord 104, and the replaceable cover 102. FIG. 5*b* also includes the boot 208 of a user. As described above, the vertical straps 210 include encasing snaps 240 disposed on an outer surface of the vertical straps 210.

In one embodiment, the vertical straps 210 also include secondary snaps (not shown in FIG. 5*b*). In one embodiment, the secondary snaps are disposed on an inner surface of the vertical straps 210 and correspond to boot snaps 503*c* disposed on a foot covering of the user.

Figure 5C:
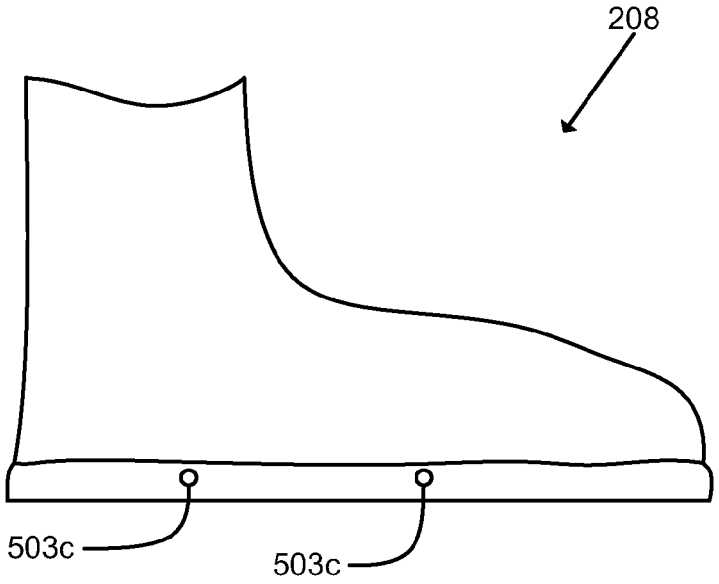
FIG. 5*c* is a side view of a boot in accordance with the present invention.

FIG. 5*c* depicts one embodiment of a boot 208 which includes boot snaps 503*c* which correspond to secondary snaps described in association with FIG. 5*b*. In one embodiment, the apparatus 100*b* is further secured to the boot 208 by securing the boot snaps 503*c* to the secondary snaps.

Figure 5D:
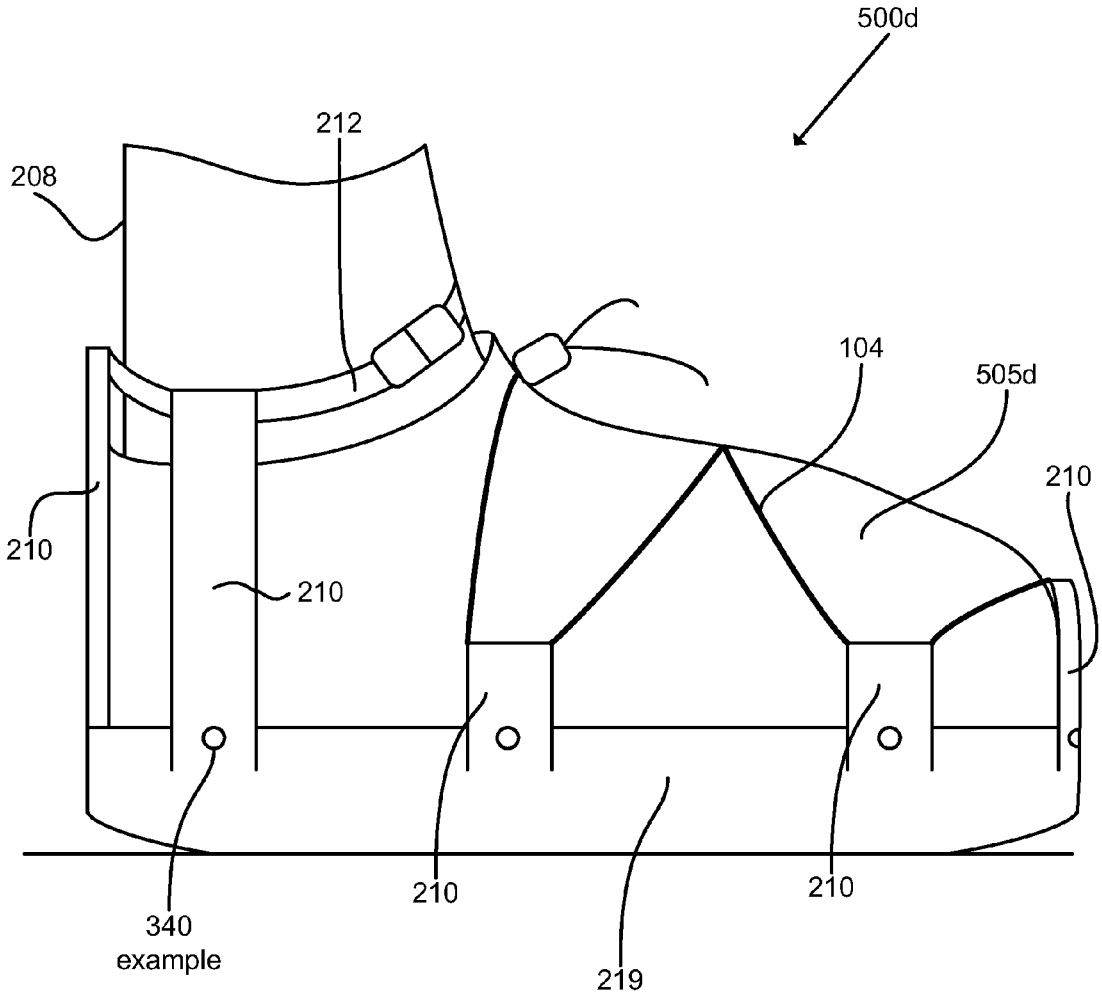
FIG. 5*d* is a side view of another embodiment of the apparatus in accordance with the present invention.

FIG. 5*d* depicts one embodiment of an apparatus 100*d* for a shoe cover that may be substantially similar to the apparatus 100 for a shoe cover of FIG. 1. The illustrated apparatus 100*d* includes the vertical straps 210, the ankle strap 212, the encasing material 219, and the cord 104. FIG. 5*d* also includes the boot 208 of a user. As described above, the encasing material 219 includes a plurality of vertical straps 210 disposed away from the bottom surface of the sole 222. In one embodiment, the vertical straps 210 include lace loops 230 disposed on distal ends 211 of the vertical straps 210. In one embodiment, the cord 104 is held to the encasing material 219 by the lace loops 230 disposed on the distal ends 211 of the vertical straps 210. In another embodiment, the cord 104 is threaded through opposing lace loops 230 to secure the apparatus 100*d* to the boot 208 of a user.

In one embodiment, the apparatus 100*d* also includes a top cover 505*d* which is connected with an outer perimeter of the sole 222 and creates a pocket for a user's foot between the top cover 505*d* and the encasing material 219. In one embodiment, the top cover 505*d* attaches to the vertical straps 210. In another embodiment, the top cover 505*d* further secures the boot 208 to the apparatus 100*d*. In one embodiment, the top cover 505*d* is made of a hard material. In another embodiment, the top cover 505*d* is made of a soft material. In one embodiment, the top cover 505*d* is made of cotton fabric. In various embodiments, the top cover 505*d* is made of leather, nylon, bungee material, plush, wool fabric, denim, canvas, and neoprene. In one embodiment, the encasing material 219 and the top cover 505*d* are made of the same material. In one embodiment, the perimeter of the encasing material 219 corresponds to the perimeter of the sole 222.

The schematic flow chart diagrams that follow are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 6:
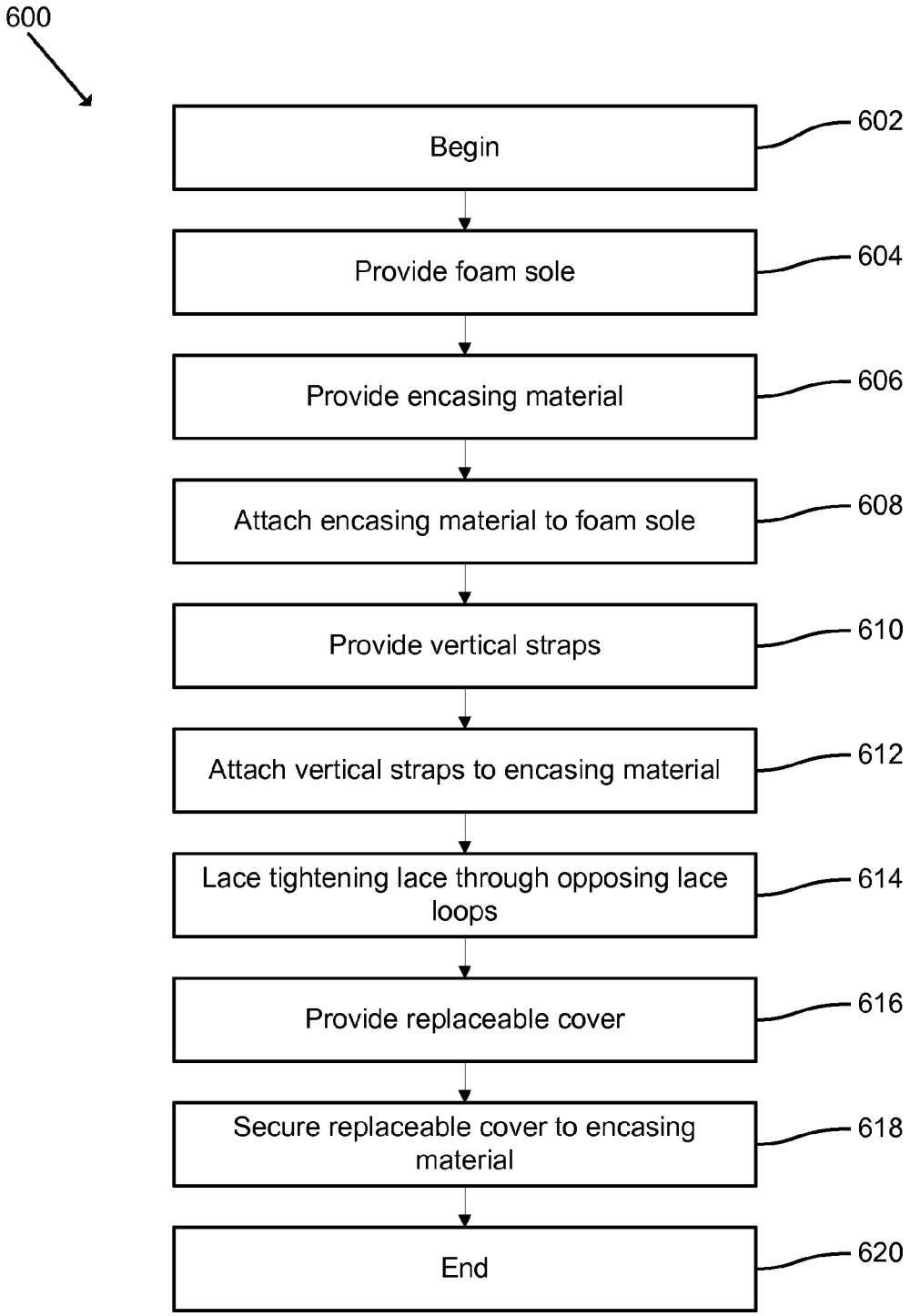
FIG. 6 is a schematic flow diagram of one embodiment of a method in accordance with the present invention.

FIG. 6 depicts a method 600 in accordance with the present invention. In one embodiment, the method begins 602 and a sole 222 is provided 604. In one embodiment, the sole 222 includes a bottom surface, a top surface 531, and a lateral surface. In one embodiment, the perimeter of the sole 222 is slightly larger than the sole of a user's shoe. The encasing material 219 is also provided 606, in one embodiment, and attached 608 to the sole 222 such that the encasing material 219 covers the bottom surface and lateral surface of the sole 222. In one embodiment, the vertical straps 210 are provided 610 and attached 612 to the encasing material 219. In one embodiment, the vertical straps 210 contain lace loops 230 configured to receive a tightening lace.

In one embodiment, the cord 104 is laced 614 through opposing lace loops 230 such that the vertical straps 210 can be pulled together by shortening the tightening lace. In another embodiment, a replaceable cover 102 is provided 616 and secured 618 to the encasing material 219 such that the replaceable cover 102 covers the encasing material 219. The method then ends 620.

In one embodiment, the method 600 also includes placing the foot of a user within the encasing material 219 and tightening the tightening lace such that the sole 222 is held to the foot of the user. In another embodiment, the method 600 also includes providing an ankle strap 212 which is attached to at least one lace loop 230. In one embodiment, the ankle strap 212 may also be attached to an ankle of a user. In another embodiment, the method 600 may include replacing the replaceable cover 102 by removing a spent replaceable cover 102 and attaching a new replaceable cover 102.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a sole comprising a bottom surface, a top surface, and a lateral surface, the lateral surface disposed between the top surface and the bottom surface and encompassing a perimeter of the sole, the perimeter of the sole having substantially the shape of a shoe sole;

an encasing material attached to and covering the bottom surface and lateral surface of the sole, the encasing material having a plurality of vertical straps disposed on a perimeter of the encasing material and extending in a direction away from the bottom surface of the sole, the vertical straps having a distal end with a fastening mechanism connected with the distal end;

a replaceable cover removably secured to the encasing material, the replaceable cover comprising flaps spaced around a main body of the replaceable cover, wherein the replaceable cover removably secures to the encasing material, the replaceable cover covering an area defined by the bottom surface of the sole; and an attachment mechanism configured to removably connect the replaceable cover with the encasing material.

2. The apparatus of claim 1, wherein the replaceable cover and the encasing material comprise traction patches, wherein the traction patches are disposed on a bottom surface of the replaceable cover, and wherein the traction patches are disposed on a top surface of the encasing material.

3. The apparatus of claim 1, wherein at least one of the vertical straps is sewn into a seam in an encasing material.

4. The apparatus of claim 1, wherein the sole is formed of a compressible, resilient material that muffles sound.

5. The apparatus of claim 1, wherein the encasing material comprises one of nylon, plush, cotton fabric, fleece, wool fabric, linen, felt, denim, canvas, latex, nylon, neoprene, leather, and terry cloth.

6. The apparatus of claim 1, further comprising a top cover connected with at least one portion of the perimeter of the sole and creating a pocket between the top cover and the encasing material.

7. The apparatus of claim 1, wherein the attachment mechanism comprises a plurality of cover snaps which correspond to a plurality of encasing snaps, the plurality of cover snaps disposed upon the flaps of the replaceable cover.

8. The apparatus of claim 1, wherein the top surface of the sole comprises a foot indentation.

9. The apparatus of claim 1, wherein the vertical straps are provided with secondary snaps disposed on an inner surface of the vertical straps, wherein the secondary snaps correspond to boot snaps disposed on a foot covering of the user.

10. The apparatus of claim 1, wherein the sole comprises a plurality of pieces of foam placed in adjacent arrangement.

11. The apparatus of claim 1, wherein the fastening mechanism comprises hook and loop fastening material.

12. An apparatus comprising:

a sole comprising a bottom surface, a top surface, and a lateral surface, the lateral surface disposed between the top surface and the bottom surface and encompassing a perimeter of the sole, the perimeter of the sole having substantially the shape of a shoe sole;

an encasing material attached to and covering the bottom surface and lateral surface of the sole, the encasing material having a plurality of vertical straps disposed on a perimeter of the encasing material and extending in a direction away from the bottom surface of the sole, the vertical straps having a distal end with a fastening mechanism connected with the distal end;

a replaceable cover removably secured to the encasing material, wherein the replaceable cover removably secures to the encasing material, the replaceable cover covering an area defined by the bottom surface of the sole;

a cord connected to the encasing material by lace loops disposed on the distal ends of the vertical straps, the cord threaded through opposing lace loops and securing the apparatus to a foot of a user; and an ankle strap attached to at least one vertical strap, the ankle strap comprising a securable, annular material configured to secure to an ankle area of the user.

13. A method comprising:

providing a sole, the sole comprising a bottom surface, a top surface, and a lateral surface, wherein the lateral surface is disposed between the top surface and the bottom surface and encompasses a perimeter of the sole, wherein the perimeter of the sole is in the shape of a shoe sole;

attaching an encasing material to the sole such that the encasing material covers the bottom surface and a lateral surface of the sole;

providing vertical straps disposed on the encasing material, wherein the vertical straps comprise lace loops that receive a cord;

lacing the cord through opposing lace loops such that the vertical straps can be pulled together by shortening the cord;

providing an attachment mechanism configured to removably connect a replaceable cover with the encasing material; and securing the replaceable cover to the encasing material such that the replaceable cover covers the bottom surface of the encasing material, the replaceable cover comprising flaps spaced around a main body of the replaceable cover.

14. The method of claim 13, wherein the vertical straps comprise encasing snaps disposed on an outer surface of the vertical straps.

15. The method of claim 13, further comprising providing an ankle strap attached to at least one lace loop.

16. The method of claim 13, wherein the replaceable cover comprises traction patches disposed on a bottom surface of the replaceable cover.

17. A system comprising:

a sole comprising a bottom surface, a top surface, and a lateral surface, the lateral surface disposed between the top surface and the bottom surface and encompassing a perimeter of the sole, the perimeter of the sole having substantially the shape of a shoe sole;

an encasing material attached to and covering the bottom surface and lateral surface of the sole, the encasing material provided with a plurality of vertical straps disposed on a perimeter of the encasing material and extending in a direction away from the bottom surface of the sole, the vertical straps being provided with annular lace loops disposed on distal ends of the vertical straps, the vertical straps provided with encasing snaps disposed on an outer surface of the vertical straps;

a replaceable cover removably secured to the encasing material, the replaceable cover removably securing to the encasing material by cover snaps which correspond to and removably secure to encasing snaps, the replaceable cover covering an area defined by the bottom surface of the sole;

a cord laced through opposing lace loops; and an ankle strap attached to at least one vertical strap, the ankle strap comprising a length of fabric material.

18. The system of claim 17, wherein the sole is configured to extend beyond a perimeter of a sole of a user's shoe.

19. The system of claim 17, further comprising at least one additional replaceable cover.

20. The system of claim 17, wherein the ankle strap further comprises a cam buckle, the cam buckle locking one lateral end of the ankle strap to an opposite lateral end of the ankle strap.

* * * * *